United States Patent [19]

Sass et al.

[11] 4,155,715

[45] May 22, 1979

[54] PROCESS FOR REDUCING THE ORGANIC SULFUR CONTENT OF CHAR

[75] Inventors: Allan Sass, Los Angeles; Hans F. Bauer, Diamond Bar; Norman W. Green, Upland, all of Calif.

[73] Assignee: Occidental Petroleum Corporation, Los Angeles, Calif.

[21] Appl. No.: 830,742

[22] Filed: Sep. 6, 1977

[51] Int. Cl.[2] ..... C10L 9/10; C10B 57/00

[52] U.S. Cl. ..... 44/1 F; 201/17

[58] Field of Search ..... 44/1 R, 1 F; 201/17

[56] References Cited

U.S. PATENT DOCUMENTS 3,938,966 2/1976 Kindig et al. ..... 44/1 R 4,052,170 10/1977 Yan ..... 44/1 R 4,054,421 10/1977 Robinson et al. ..... 44/1 F

FOREIGN PATENT DOCUMENTS 943093 3/1974 Canada ..... 44/1 R

*Primary Examiner*—Carl Dees

*Attorney, Agent, or Firm*—Fulwider, Patton, Rieber, Lee & Utecht

[57] ABSTRACT

This invention covers an improved hydrodesulfurization process which significantly reduces the organic sulfur content of char by first magnetically or electrostatically removing iron sulfides and precursors of iron sulfides from char and then hydrodesulfurizing the remaining char.

3 Claims, No Drawings

PROCESS FOR REDUCING THE ORGANIC SULFUR CONTENT OF CHAR

BACKGROUND OF THE INVENTION

Char is used as a fuel and is manufactured by partially pyrolyzing coal or other carbonaceous materials. Char contains sulfur which is objectionable because upon combustion, the sulfur forms sulfur dioxide, an air pollutant. Governmental air purity standards limit the use of char of fuels containing relatively low concentrations of sulfur. The presence of sulfur concentrations which exceed such limits has restricted the use of char as a fuel. The need for a relatively sulfur-free char has therefore become very important, especially in view of dwingling supplies of oil and natural gas and abundant supplies of coal.

The sulfur content of char is present in many forms such as organic sulfur, pyritic sulfur and sulfide sulfur. Organic sulfur is the sulfur which forms a part of organic molecules contained in the char. Pyritic sulfur is the sulfur that forms a part of iron pyrite, $FeS_2$, found in char. Sulfide sulfur is the sulfur that forms a part of inorganic sulfur compounds found in char, such as, for example, FeS and CaS. Pyritic sulfur is an inorganic sulfur but is generally not comprehended by the term "sulfide sulfur" as used in the art.

Sulfur bound to organic molecules is probably the most difficult form of sulfur to completely remove from char due to the strong, complex organic bonds which tightly hold onto it and stubbornly refuse to give it up. Methods are being devised to significantly reduce the content of pyritic and sulfide sulfur in char, and while such methods may also cause some reduction in the organic sulfur content they have not been able to substantially reduce the organic sulfur in char.

SUMMARY OF THE INVENTION

It has been discovered that if iron sulfide and pyrrhotite, which is a species of iron sulfide, and the precursors of such iron sulfides, are removed from char and the char treated with hydrogen gas at elevated temperatures, nearly all of the organic sulfur is removed from the char. This is indeed surprising in view of the belief in the art that iron sulfides act as a hydrogenation catalyst and would be expected to promote and not hinder the desulfurization of char.

Another unexpected benefit resulting from the removal of iron sulfides and their precursors as as aforesaid is the ability to use hydrogen gas containing $H_2S$ for said hydrodesulfurization. The presence of $H_2S$ in hydrogen gas used for hydrodesulfurization of organic sulfur in coal char generally has an inhibiting effect upon the removal of organic sulfur. With the removal of iron sulfides and the precursors thereof, it has been found that the presence of $H_2S$ in amounts up to about 5% by volume of hydrogen gas does not have this same inhibiting effect and hydrodesulfurization of the organic sulfur may proceed to near zero despite the presence of $H_2S$.

In addition to the foregoing, it has been noted that when iron sulfides and the precursors thereof are removed prior to hydrodesulfurization, hydrodesulfurization of organic sulfur proceeds at a much faster rate and by the use of much less hydrogen as compared to the hydrodesulfurization of char in which the iron sulfides and their precursors have not been removed.

EMBODIMENTS OF THE INVENTION

Iron-sulfur compounds in char exist in many forms such as, for example, pyrite ($FeS_2$), magnetite ($Fe_3O_4$), organic iron salts ($Fe(OR)_3$), iron sulfide (FeS, or $Fe_2S_3$), and pyrrhotite ($Fe_6S_7$ to $Fe_{16}S_{17}$). Iron sulfide, does not generally exist in char as one mole of Fe combined with one mole of S because of ionic defects in the Fe and S molecules. These ionic defects result in a lattice work of iron-sulfur molecules which are not stoichiometrically balanced between Fe and S. For the sake of convenience, however, "sulfides of iron" as used herein shall comprehend iron sulfide and/or pyrrhotite without attempting to account for the exact ratio between Fe and S in the molecule. Pyrite is not comprehended by the term "sulfides of iron" as used herein.

The aforesaid iron-sulfur compounds can exist naturally in coal and can be produced during the conversion of coal to char, such as the $Fe_6S_7$ form of pyrhhotite which is produced by the decomposition of pyrite ($FeS_2$) at about 1000° F. to about 1200° F.

For some reason which is not fully understood, it appears that iron sulfides present in char attract $H_2S$ which produces localized concentrations of $H_2S$ around the surface of the sulfides of iron. As a result, the $H_2S$ concentration in the char is relatively high and tends to prevent the hydrogen from contacting and reacting with the sulfur forms in the char. Where the hydrogen gas does contact the sulfur forms, the aforesaid high concentrations of $H_2S$ dilutes the hydrogen and tends to inhibit the formation of any more $H_2S$.

To prevent this undesirable surface phenomenon, it is necessary to remove the sulfides of iron from the char. However, because metallic iron (Fe) and the other iron-sulfur or iron oxygen compounds, such as pyrite and magnetite, are precursors of sulfides of iron, it is necessary to remove these materials from the char as well as the sulfides of iron. With the sulfides of iron and their precursors removed, the char may be hydrodesulfurized by conventional techniques and the organic sulfur content reduced to near zero.

The removal of sulfides of iron and their precursors is most readily accomplished by conventional magnetic or electro-magnetic separation means inasmuch as all of the aforesaid iron-sulfur compounds are magnetic to one degree or other and have varying dielectric properties.

In utilizing the aforesaid electrical or magnetic separation techniques, it is preferable to first coarse grind the carbonaceous material, such as coal, from which the char is to be manufactured, and then beneficiate the coarse ground material for ash removal. Thereafter, the coarse ground carbonaceous material is find ground and flash pyrolyzed to produce char which is subjected to magnetic or electrostatic separation means by conventional procedures.

EXAMPLE I

Char was produced from bituminous coal. A portion of this char was leached with acid to remove the sulfides of iron, and a like portion was not leached with acid. Both portions were treated with pure hydrogen gas at 1700° F. at 65 psia for 10 minutes and analyzed to determine the weight percent of organic sulfur reduction. The char that did not have the sulfides of iron removed had its organic sulfur content reduced only from 0.72% to 0.61%, whereas the char that had its sulfides of iron removed pursuant to the present invention had its organic sulfur content reduced from 0.76% to 0.13%.

EXAMPLE II

Example I was repeated except that the hydrogen gas used to treat the char contained about 1% of $H_2S$ by volume. When the two portions of char were treated with hydrogen gas containing $H_2S$, no reduction in the organic sulfur content of the char containing the sulfides of sulfur could be measured, whereas the organic sulfur content of the char having its sulfides of iron removed pursuant to the present invention was reduced from 0.76% to 0.35%.

The invention set forth herein has been described in terms of the removal of organic sulfur from char manufactured from coal. It is to be understood, however, that the instant invention is not limited thereto but may be used to reduce the organic sulfur content of char manufactured from other carbonaceous materials. It is to be further understood that this invention is intended to cover all changes and modifications in such operating conditions which fall within the spirit and scope of the invention.

We claim:

1. In a hydrodesulfurization process for reducing the organic sulfur content of char, the improvement comprising the steps of:

(a) magnetically or electrostatically removing the sulfides of iron and the precursors thereof from char, said precursors including those which are not soluble in acid, and (b) hydrosulfurizing the remaining char with hydrogen gas to reduce the organic sulfur content thereof.

2. In a hydrodesulfurization process as set forth in claim 1 wherein said hydrogen contains up to about 1% by volume of hydrogen sulfide gas.

3. In a hydrodesulfurization process as set forth in claim 1 wherein said hydrogen contains up to about 5% by volume of hydrogen sulfide gas.

* * * * *

UNITED STATES PATENT AND TRADEMARK OFFICE

CERTIFICATE OF CORRECTION

PATENT NO. : 4,155,715

DATED : May 22, 1979

INVENTOR(S) : Allan Sass, Hans F. Bauer and Norman W. Green

It is certified that error appears in the above-identified patent and that said Letters Patent are hereby corrected as shown below:

Column 1, line 11, after "char" delete "of" and substitute -- to -- therefor;

Column 1, line 50, after "precursors" delete "as" (first occurence).

Signed and Sealed this

*Twelfth* Day of *February 1980*

[SEAL]

*Attest:*

SIDNEY A. DIAMOND

*Attesting Officer*

*Commissioner of Patents and Trademarks*